US005268618A

United States Patent [19]

Chen

[11] Patent Number: 5,268,618

[45] Date of Patent: Dec. 7, 1993

[54] LINEARITY COMPENSATION METHOD AND VARIABLE MAGNETIC FIELD STRENGTH LINEARITY COMPENSATION APPARATUS FOR A MULTI-SCANNING MONITOR

[76] Inventor: James Chen, No. 52, Sec. 2, An-Kang Rd., Hsintien City, Taiwan

[21] Appl. No.: 837,049

[22] Filed: Feb. 18, 1992

[51] Int. Cl.[5] ..... G09G 1/04; H01H 1/00

[52] U.S. Cl. ..... 315/370; 335/213

[58] Field of Search ..... 315/370, 371, 399; 335/210, 211, 212, 213; 336/30, 145, 146, 147, 184

[56] References Cited

U.S. PATENT DOCUMENTS

| | | | |
|---|---|---|---|
| 4,393,361 | 7/1983 | Horton | 335/212 |
| 4,713,589 | 12/1987 | Kashiwagi | 315/400 |
| 4,795,946 | 1/1989 | Nishiyama | 315/370 |
| 4,871,951 | 10/1989 | Teuling | 315/408 |

*Primary Examiner*—Gregory C. Issing
*Attorney, Agent, or Firm*—Matthew K. Ryan

[57] ABSTRACT

A linearity compensation apparatus for a multi-scanning monitor which has a magnetic deflection-type cathode ray tube includes a linearity coil to be connected in series with the deflection coil of a horizontal deflection system of the multi-scanning monitor. An electromagnet has a core connected to the linearity coil and a line coil wound on the core thereof. A current control circuit controls the amount of current flowing through the line coil of the electromagnet so as to correspond with the horizontal scanning frequency from an external display adapter, thereby varying the magnetic field strength of the electromagnet in order to vary automatically the relationship between the inductance and the current flowing through the linearity coil in accordance with the magnitude of the horizontal scanning frequency.

2 Claims, 14 Drawing Sheets (a)

(c)

(b)

(a)

(b)

(a2)

LINEARITY COMPENSATION METHOD AND VARIABLE MAGNETIC FIELD STRENGTH LINEARITY COMPENSATION APPARATUS FOR A MULTI-SCANNING MONITOR

BACKGROUND OF THE INVENTION

1. Field of the Invention

The invention relates to cathode ray tubes (CRT) with magnetic deflection systems, more particularly to a linearity compensation method using a variable magnetic field strength linearity compensation apparatus for a CRT with a magnetic deflection system.

2. Description of the Related Art

There is a wide range of display adapters presently available so as to make computer monitors suitable for a variety of applications. Such display adapters, which have different horizontal scanning frequencies and screen resolutions, include:

1. A CGA display adapter which has a horizontal scanning frequency of 15.7 kHz and a resolution of 640 * 200 (number of picture elements x number of scan line).

2. An EGA display adapter which has a horizontal scanning frequency of 21.8 kHz and a resolution of 720 * 350.

3. A VGA display adapter which has a horizontal scanning frequency of 31.5 kHz and a resolution of 640 * 350, 640 * 400 or 640 * 480.

4. A VGA (8514) display adapter which has a horizontal scanning frequency of 35.5 kHz and a resolution of 1024 * 768.

5. A SUPER VGA display adapter which has a horizontal scanning frequency of 37.8 kHz and a resolution of 800 * 600.

6. A NON-INTERLACE (8514) VGA display adapter which has a horizontal scanning frequency of 48.9 kHz and a resolution of 1024 * 768.

Computers are usually provided with a multi-scanning type computer monitor so as to make them compatible with two or more display adapters having different scanning frequencies and resolutions.

In a conventional computer monitor with a magnetic deflection-type cathode ray tube (CRT), a linearity coil is usually connected in series with the horizontal deflection system of the CRT. Referring to FIG. 1(A), the horizontal deflection system (10) includes a deflection coil (11), a transistor (12) and a damper diode (13). Because of the internal resistances of the deflection coil (11), the transistor (12) and the damper diode (13), the current at the front portion of each scanning cycle is greater than the current at the rear portion of the scanning cycle. If no linearity coil is used, the characters on the left portion of the CRT will be larger than the characters on the right portion of the CRT.

FIGS. 1(B) to 1(F) illustrate the signal waveforms at different nodes of the horizontal deflection system (10) shown in FIG. 1(A). FIGS. 2(A) to 2(D) are equivalent circuits of the horizontal deflection system (10) under different periods of one scanning cycle. A horizontal driving signal (Vb), as shown in FIG. 1(B), is fed to the base terminal of the transistor (12). During the t0–t1 period of the driving signal (Vb), the damper diode (13) is in a reverse bias condition, while the transistor (12) is in a conducting state. The equivalent circuit of the horizontal deflection system (10) at this stage is shown in FIG. 2(A).

The transistor (12) is cut off during the t1–t2 period of the driving signal (Vb). That is, no current ($i_c$) flows through the collector of the transistor (12), as shown in FIGS. 1(C) and 2(B). The voltage ($V_c$) across a capacitor (C) increases until a peak voltage ($V_{cp}$) is reached, as shown in FIG. 1(F). The capacitor (C) discharges during the t2–t3 period of the driving signal (Vb) via the deflection coil (11), as shown in FIGS. 1(F) and 2(C). During the t3–t4 period of the driving signal (Vb), full discharging of the capacitor (C) has been completed, and the damper diode (13) starts to conduct, as shown in FIG. 1(E). The equivalent circuit of the horizontal deflection system (10) at this stage is shown in FIG. 2(D).

From the foregoing discussion, it has been shown that the internal resistance of the horizontal deflection system (10) is approximately equal to (R1) during the t0–t1 period of the driving signal (Vb), wherein (R1) is equal to the sum of the internal resistances of the deflection coil (11) and the transistor (12), and is approximately equal to (R2) during the t3–t4 period of the driving signal (Vb), wherein (R2) is equal to the sum of the internal resistances of the deflection coil (11) and the damper diode (13).

FIGS. 3(A) and 3(B) are equivalent circuits of the horizontal deflection system (10) during the t0–t1 and t3–t4 periods of the driving signal (Vb) when redrawn to include the internal resistances (R1, R2). The voltage ($V_{Ly}$) across the deflection coil (11) is equal to $[E-i_yR1]$ during the t0–t1 period of the driving signal (Vb), and is equal to $[E+i_yR2]$ during the t3–t4 period of the driving signal (Vb). Thus, regardless of the values of the internal resistances (R1, R2), the characters on the left portion of the CRT will be larger than the characters on the right portion of the CRT unless a linearity coil is installed. FIG. 3(C) illustrate plots of the current ($i_y$) flowing through the deflection coil (11) during ideal and normal conditions. The equations $[(E/L_y) * t]$ and $\{(E/L_y) * [t-(T_s/2)]\}$ correspond to the current ($I_y$) during ideal conditions [that is, the internal resistance of the horizontal deflection system (10) is equal to zero]. The equations $(E/R1) * \{1-\exp[-(t * R1/L_y)]\}$ and $(E/R2) * (1-\exp\{-[t-(T_S/2)]*R2/L_y]\})$ correspond to the current ($i_y$) during normal conditions wherein the internal resistance of the horizontal deflection system (10) is taken into consideration. Note that during the t0–t1 period of the driving signal (Vb), the effect of internal resistance is to reduce the voltage across the deflection coil (11), while during the t3–t4 period of the driving signal (Vb), the effect of internal resistance is to increase the voltage across the deflection coil (11).

The purpose of the linearity coil is to compensate for linearity variations due to the internal resistance of the horizontal deflection system (10) of the CRT. The principle of the linearity coil is as follows:

Referring to FIG. 4(A), a conventional coil device (C) is shown to comprise a coil wound on an I-shaped ferrate core. FIG. 4(B) is a B–H curve for the magnetic circuit shown in FIG. 4(A). Note that a substantial increase in the flux density of the coil device (C) is not possible because of magnetic hysteresis. FIG. 4(C) is a plot of current ($i_y$) vs. inductance (L) for the coil device (C). Note that the coil device (C) becomes more and more saturated as the absolute magnitude of the current ($i_y$) increases.

Referring to FIG. 5(A), a stationary permanent magnet (A) of appropriate magnetic field strength is mounted on one end of the core of the coil device (C)

shown in FIG. 4(A). A plot of current ($i_y$) vs. inductance (L) for the magnetic circuit shown in FIG. 5(A) is shown in FIG. 5(B). Note that the effect of providing the magnet (A) on one end of the core is to shift the current ($i_y$) vs. inductance (L) curve shown in FIG. 4(C) to the left of the vertical axis. The degree of shift depends upon the magnetic field strength of the magnet (A). From the current ($i_y$) vs. inductance (L) curve shown in FIG. 5(B), it can be seen that the magnetic circuit becomes more and more saturated [that is, the value of the inductance (L) decreases] as the value of current ($i_y$) increases in the positive direction. However, the value of the inductance (L) increases as the value of current ($i_y$) increases in the negative direction. The magnetic circuit shown in FIG. 5(A) is a conventional linearity coil used to compensate for linearity variations due to the internal resistance of the horizontal deflection system (10) of the CRT.

One of the drawbacks of the above described linearity coil is that the inductance of the coil and the current flowing therethrough cannot be tuned so as to correspond with the horizontal scanning frequency.

FIG. 5(C) is an illustration of another conventional linearity coil. The linearity coil is substantially similar to that shown in FIG. 5(A). However, the permanent magnet (A') is not mounted on one end of the core of the coil device (C) but is instead rotatably mounted adjacent to the core so as to provide a magnetic field which is adjustably combined with the magnetic field of the coil device (C), thereby permitting adjustments in the permeability of the core and hence, the relationship between the inductance of the linearity coil and the current flow therethrough. The effect of rotating the permanent magnet (A') is to permit initial adjustments in the degree of shifting of the current ($i_y$) vs. inductance (L) curve, shown in FIG. 4(C), so as to obtain the best linearity compensation effect.

The linearity coil shown in FIG. 5(C) is ideal for use in cathode ray tubes which have a fixed horizontal scanning frequency, and is inconvenient for use in multi-scanning monitors since the linearity coil has to be tuned each time the horizontal scanning frequency varies.

Referring once more to FIGS. 3(A), 3(B) and 3(C), the voltage signal (E) should correspond to the horizontal scanning frequency so as to obtain a fixed scan width. If the horizontal scanning frequency is variable, as is the case in multi-scanning computer monitors, the voltage signal (E) is correspondingly varied.

It should be noted that the effect of the internal resistance of the horizontal deflection system (10) on the linearity distortion of the CRT is more severe when the magnitude of the voltage signal (E) is relatively small and is less severe when the magnitude of the voltage signal (E) is relatively large. This illustrates why multi-scanning monitors require a linearity compensation apparatus that has a magnetic field strength which can be automatically adjusted for a wide range of scanning frequencies.

FIGS. 6(A) and 6(B) are schematic electrical circuit diagrams of conventional linearity compensation apparatuses used in multi-scanning monitors. FIG. 6(A) illustrates a two-stage linearity compensation apparatus. When the horizontal scanning frequency is in a lower frequency range (such as 30 kHz to 45 kHz), the relay (23) is turned off, thereby connecting a pair of linearity coils (21, 22). This results in the generation of a deflection coil current vs. inductance curve with a relatively large negative slope, thereby negating the severe effects of internal resistance when the voltage signal (E) is relatively low. When the horizontal scanning frequency is in a higher frequency range (such as 45 kHz to 60 kHz), the relay (23) is turned on, thereby shorting the linearity coil (22). A deflection coil current vs. inductance curve with a smaller negative slope is generated, thus negating the effects of internal resistance when the voltage signal (E) is relatively high.

FIG. 6(B) illustrates a three-stage type linearity compensation apparatus which includes three linearity coils (31, 32, 33) and a pair of relays (34, 35) which are tuned to different ranges of horizontal scanning frequency. The operation of the linearity compensation apparatus shown in FIG. 6(B) is substantially similar to that shown in FIG. 6(A) and will not be detailed further.

The main drawbacks of the conventional linearity compensation apparatuses shown in FIGS. 6(A) and 6(B), regardless of the number of linearity coils employed, are as follows:

1. The linearity compensation effects at scanning frequencies near the upper and lower limits of the predesigned frequency ranges are relatively poor.

2. The conventional linearity compensation apparatuses are relatively expensive since they employ relays (23, or 34, 35).

3. Although increasing the number of linearity coils provides better linearity compensation, the size, complexity and cost of the system is correspondingly increased.

SUMMARY OF THE INVENTION

Therefore, the main objective of the present invention is to provide a linearity compensation method and a variable magnetic field strength linearity compensation apparatus for a multi-scanning computer monitor, which linearity compensation apparatus is relatively small, low cost and simple in construction.

Accordingly, the preferred embodiment of a linearity compensation apparatus of the present invention is to be installed in a multi-scanning monitor which has a magnetic deflection-type cathode ray tube, a voltage signal which corresponds to a horizontal scanning frequency from an external display adapter, and a horizontal deflection system with a deflection coil.

The linearity compensation apparatus comprises a linearity coil to be connected in series with the deflection coil, an electromagnet having a core mounted to the linearity coil and a line coil wound on the core, and a current control circuit means receiving the voltage signal from the multi-scanning monitor. The current control circuit means controls the amount of current flowing through the line coil of the electromagnet so as to correspond with the voltage signal from the multi-scanning monitor, thereby varying the magnetic field strength of the electromagnet in order to vary automatically the relationship between the inductance and the current flowing through the linearity coil in accordance with the magnitude of the horizontal scanning frequency from the external display adapter.

BRIEF DESCRIPTION OF THE DRAWINGS

Other features and advantages of the present invention will become apparent in the following detailed description of the preferred embodiments, with reference to the accompanying drawings, of which:

FIGS. 7(C1) and 7(C2) illustrate the conventional linearity coil shown in FIG. 5(C) when provided with an electromagnet in accordance with the linearity compensation method of the present invention;

DETAILED DESCRIPTION OF THE PREFERRED EMBODIMENTS

Figure 1A:
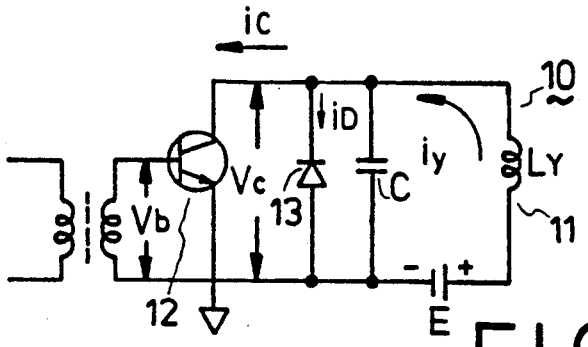
FIG. 1(A) PRIOR ART
FIG. 1(A) is a schematic circuit diagram of the horizontal deflection system for a conventional magnetic deflection-type cathode ray tube.
Figure 1B:
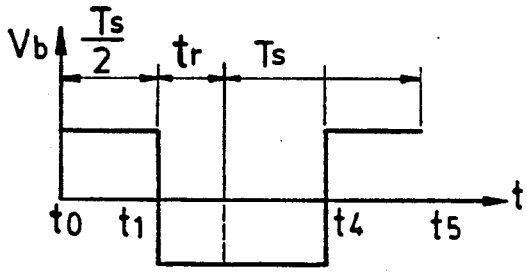
FIG. 1(B) PRIOR ART
FIGS. 1(B) to 1(F) are signal waveforms at different nodes of the horizontal deflection system shown in FIG. 1(A)
Figure 1C:
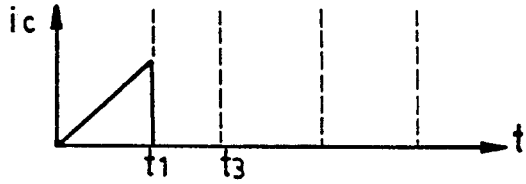
FIG. 1(C) PRIOR ART
Figure 1D:
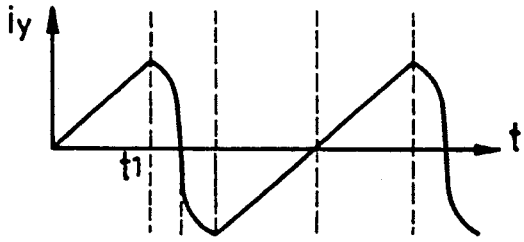
FIG. 1(D) PRIOR ART
Figure 1E:
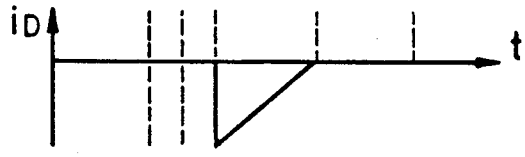
FIG. 1(E) PRIOR ART
Figure 1F:
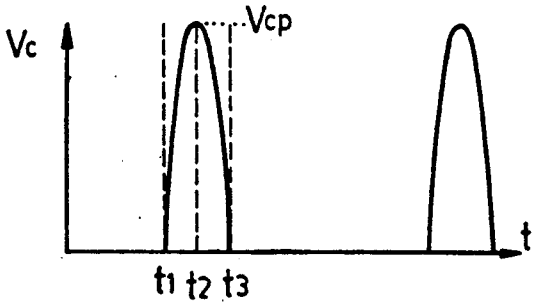
FIG. 1(F) PRIOR ART
Figure 2A:
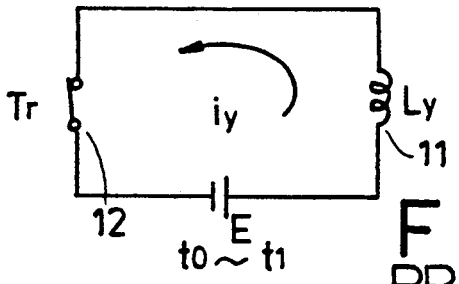
FIG. 2(A) PRIOR ART
FIGS. 2(A) to 2(D) are equivalent circuits of the horizontal deflection system shown in FIG. 1(A) under different periods of one scanning cycle.
Figure 2B:
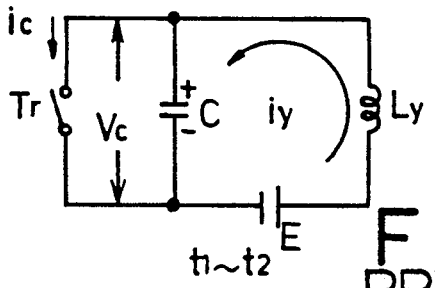
FIG. 2(B) PRIOR ART
Figure 2C:
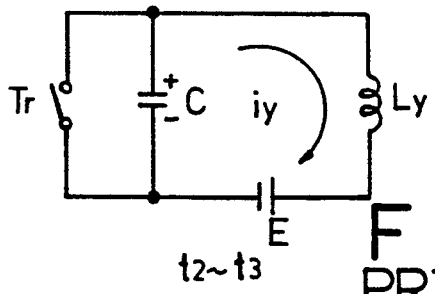
FIG. 2(C) PRIOR ART
Figure 2D:
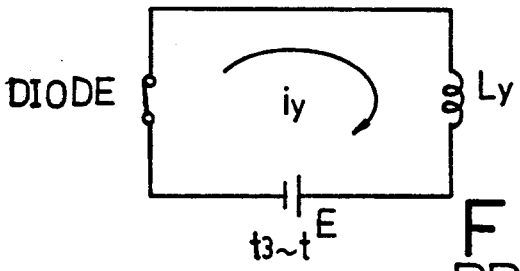
FIG. 2(D) PRIOR ART
Figure 3A:
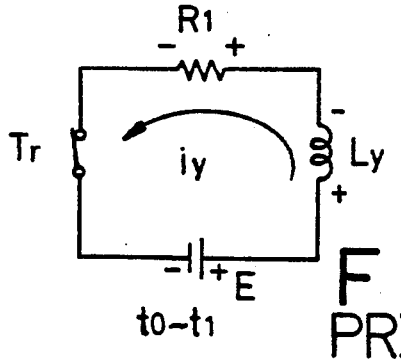
FIG. 3(A) PRIOR ART
FIGS. 3(A) and 3(B) are equivalent circuits of the horizontal deflection system shown in FIG. 1(A) at the front and latter portions of one scanning cycle when redrawn to include the internal resistance of the horizontal deflection system.
Figure 3B:
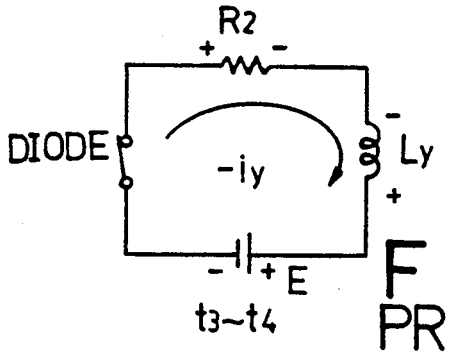
FIG. 3(B) PRIOR ART
Figure 3C:
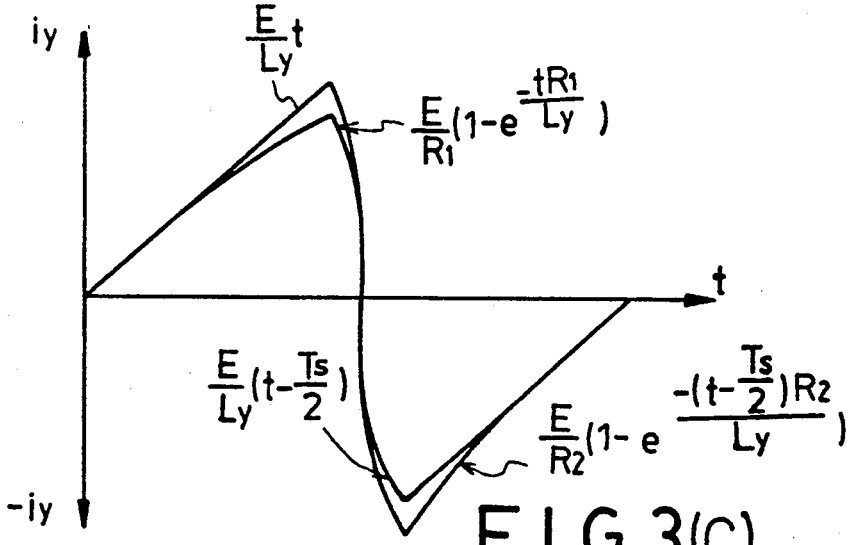
FIG. 3(C) PRIOR ART
FIG. 3(C) illustrates plots of the current flowing through a deflection coil of the horizontal deflection system during ideal and normal conditions.
Figure 4B:
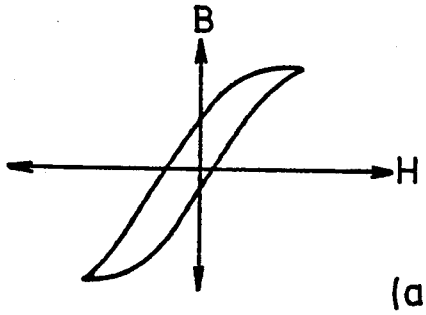
FIG. 4(B) PRIOR ART
FIG. 4(B) illustrates a B–H curve for the coil device shown in FIG. 4(A)
Figure 4A:
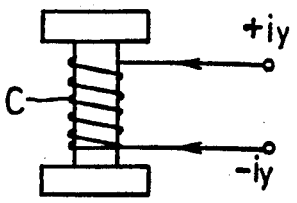
FIG. 4(A) PRIOR ART
FIG. 4(A) is an illustration of a conventional coil device.
Figure 4C:
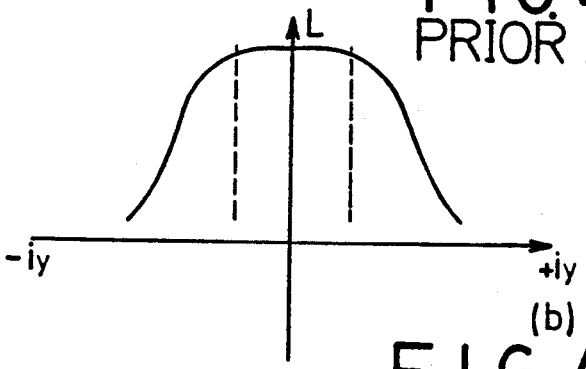
FIG. 4(C) PRIOR ART
FIG. 4(C) is a plot of current ($i_y$) vs. inductance (L) for the coil device shown in FIG. 4A.

Before proceeding with the detailed description of the preferred embodiments, it should be noted that like elements are indicated by like reference numerals throughout the disclosure.

Figure 5B:
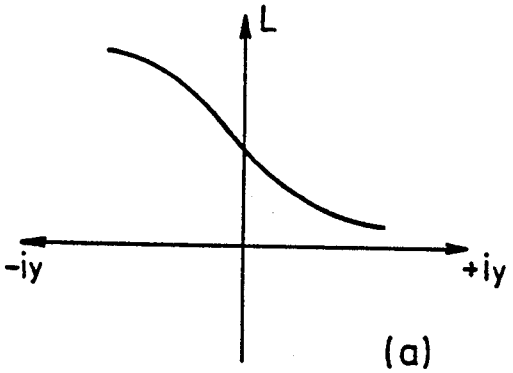
FIG. 5(B) PRIOR ART
FIG. 5(B) is a plot of current ($i_y$) vs. inductance (L) for the linearity coil shown in FIG. 5A.
Figure 5A:
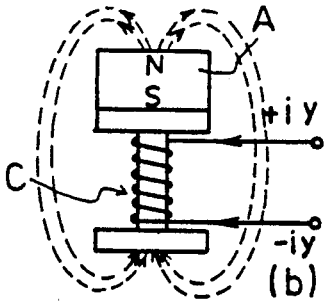
FIG. 5(A) PRIOR ART
FIG. 5(A) illustrates a conventional linearity coil for the horizontal deflection system shown in FIG. 1(A)
Figure 7:
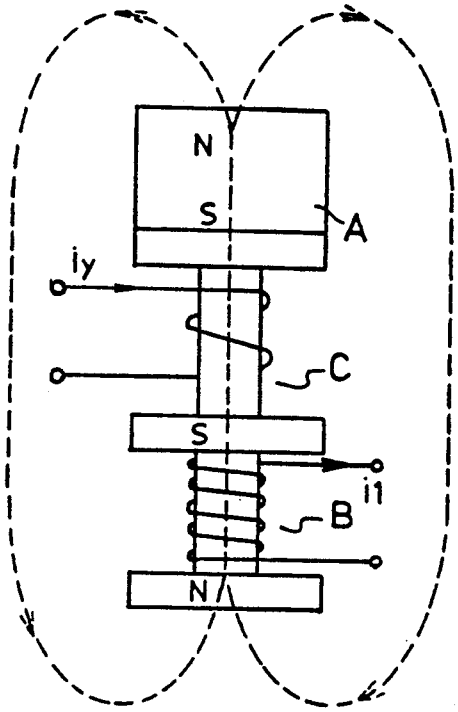
FIGS. 7(A1) and 7(A2) illustrate the conventional linearity coil shown in FIG. 5(A) when provided with an electromagnet in accordance with the linearity compensation method of the present invention.
Figure 7:
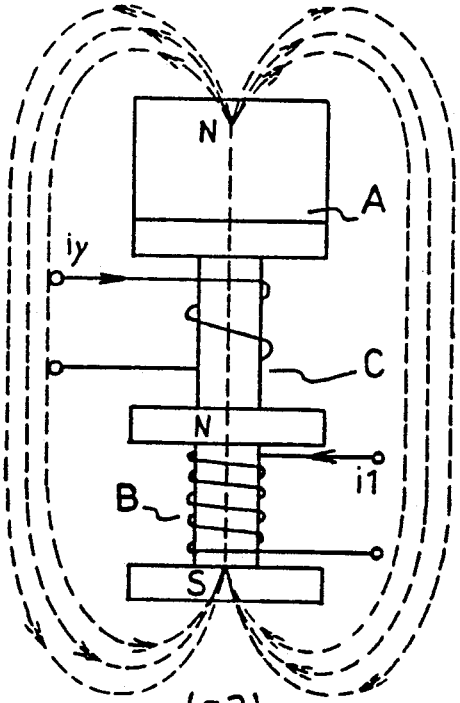

Referring to FIGS. 7(A1) and 7(A2), the conventional linearity coil shown in FIG. 5(A) is connected to an electromagnet (B) according to the linearity compensation method of the present invention. The electromagnet (B) comprises a line coil wound on an inverted T-shaped iron core. The core of the electromagnet (B) is mounted on one end of the I-shaped core of the conventional linearity coil. The coil member of the linearity coil is to be connected to the horizontal deflection system of a CRT. The electromagnet (B) can be used to vary the relationship between the inductance of the linearity coil and the deflection coil current ($i_y$) therethrough by varying the current flow through the line coil of the electromagnet (B) so as to adjust the magnetic field strength thereof. The polarity of the electromagnet (B) correspondingly changes when the direction of current flow through the electromagnet (B) changes.

Figure 7B:
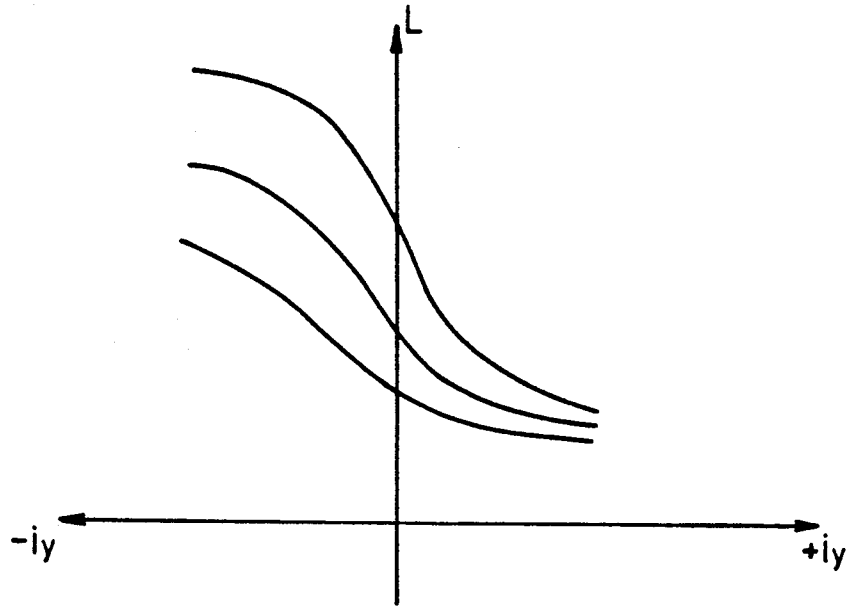
FIG. 7(B) illustrate three current ($i_y$) vs. inductance (L) curves for the magnetic circuits shown in FIGS. 7(A1) and 7(A2)
Figure 7:
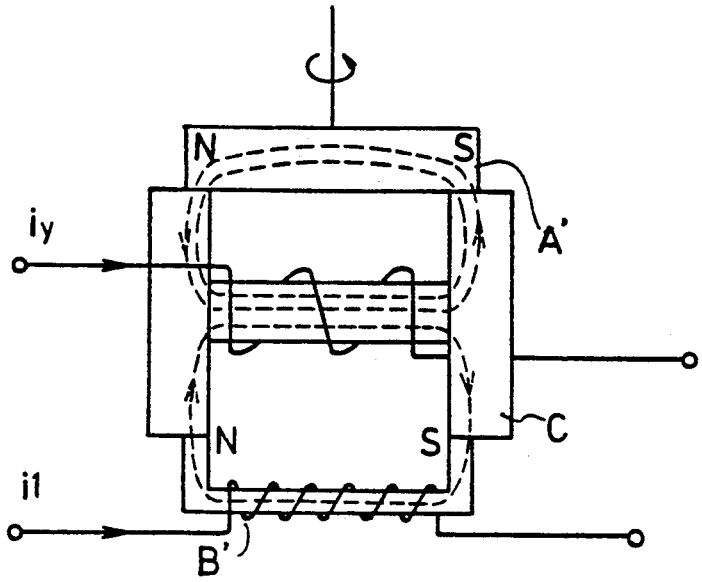
Figure 7:
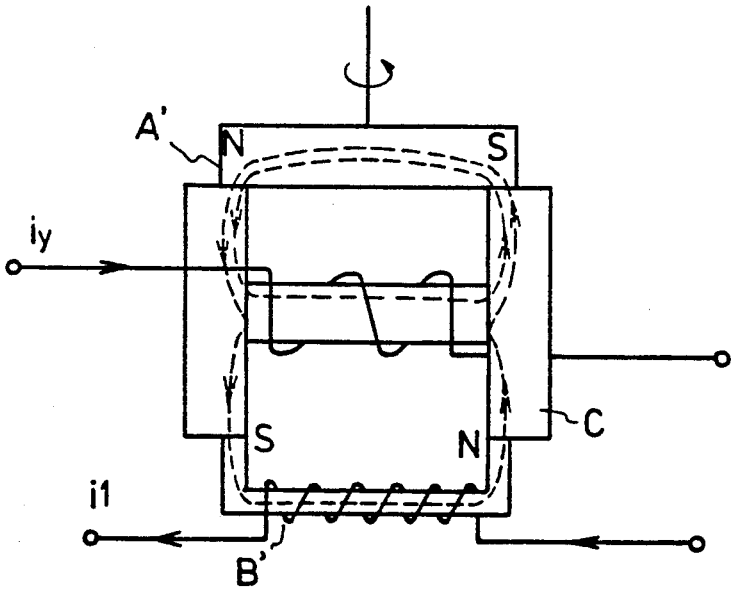

FIG. 7(B) shows three current ($i_y$) vs. inductance (L) curves which illustrate the effects of the permanent magnet (A) and the electromagnet (B) on the relationship between the inductance of the linearity coil and the current ($i_y$). The lowermost curve is obtained when the direction of magnetic flux from the electromagnet (B) is the same as those from the permanent magnet (A), thereby increasing the magnetic field strength of the linearity coil, as shown in FIG. 7(A2). The flux density of the core of the linearity coil is increased, thus enabling the linearity coil to become more saturable [that is, a current ($i_y$) vs. inductance (L) curve with a relatively small negative slope is obtained]. The intermediate curve is obtained when the electromagnet (B) is deactivated. The uppermost curve is obtained when the direction of magnetic flux from the electromagnet (B) is opposite to those from the permanent magnet (A), thereby reducing the magnetic field strength of the linearity coil, as shown in FIG. 7(A1). The flux density of the core of the linearity coil is decreased, thus enabling the linearity coil to become less saturable [that is, a current ($i_y$) vs. inductance (L) curve with a relatively large negative slope is obtained].

Figure 5C:
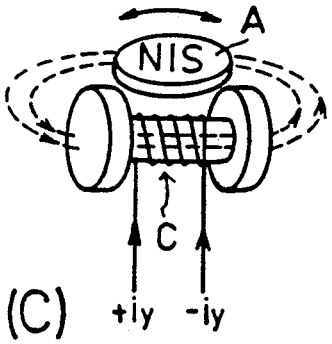
FIG. 5(C) PRIOR ART
FIG. 5(C) is an illustration of another conventional linearity coil.
Figure 6A:
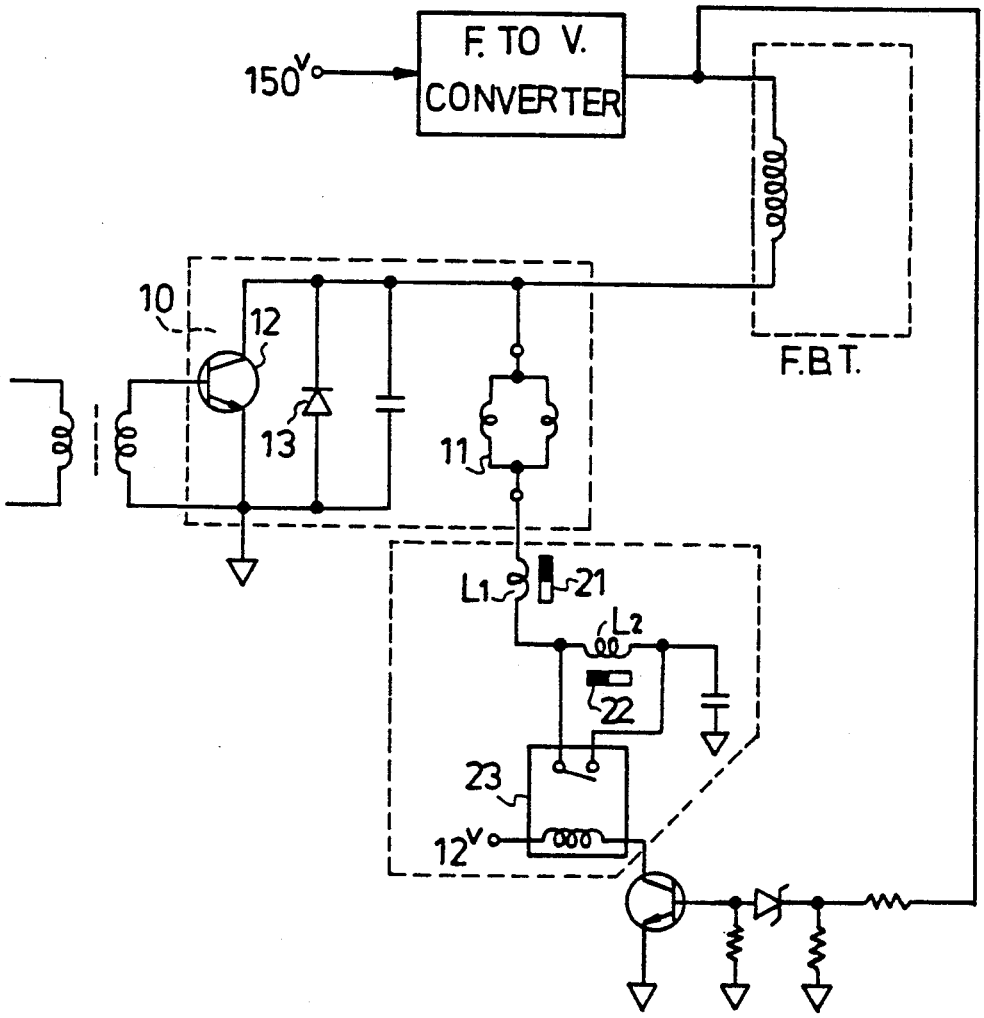
FIG. 6(A) PRIOR ART
FIG. 6(A) is a schematic circuit diagram of a conventional two-stage linearity compensation apparatus used in multi-scanning monitors.
Figure 6:
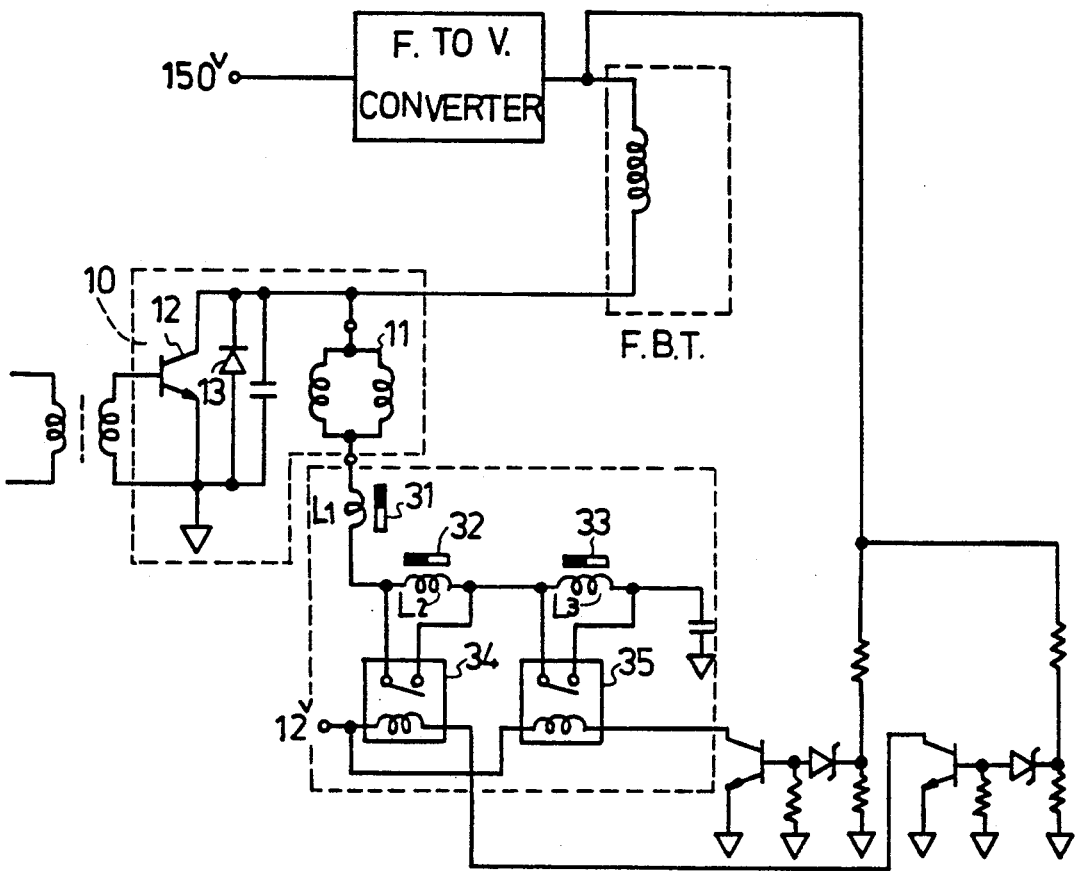
F I G. 6 (B) PRIOR ART
FIG. 6(B) is a schematic circuit diagram of a conventional three-stage linearity compensation apparatus used in multi-scanning monitors.

Referring to FIGS. 7(C1) and 7(C2), the conventional linearity coil shown in FIG. 5(C) is connected to an electromagnet (B') according to the linearity compensation method of the present invention. The electromagnet (B') comprises a line coil wound on an intermediate portion of a U-shaped iron core. The core of the electromagnet (B') has two ends mounted on a respective end of the core of the conventional linearity coil. As with the magnetic circuit shown in FIGS. 7(A1) and 7(A2), the coil member of the conventional linearity coil is to be connected to the horizontal deflection system of a CRT, while the electromagnet (B') is used to vary the relationship between the inductance of the linearity coil and the current ($i_y$) therethrough. The operation of the magnetic circuit shown in FIGS. 7(C1) and 7(C2) is substantially similar to that shown in FIGS. 7(A1) and 7(A2) and will not be discussed in greater detail. However, the magnetic circuit shown in FIGS. 7(C1) and 7(C2) permits adjustments in the relationship between the inductance of the linearity coil and the current ($i_y$) by simply rotating the permanent magnet (A').

A current control circuit is required to control the magnitude and the direction of current flow through the electromagnets (B, B'). FIGS. 8 to 12 illustrate the different preferred embodiments of a variable magnetic field strength linearity compensation apparatus (1a–1e) of the present invention.

Figure 8:
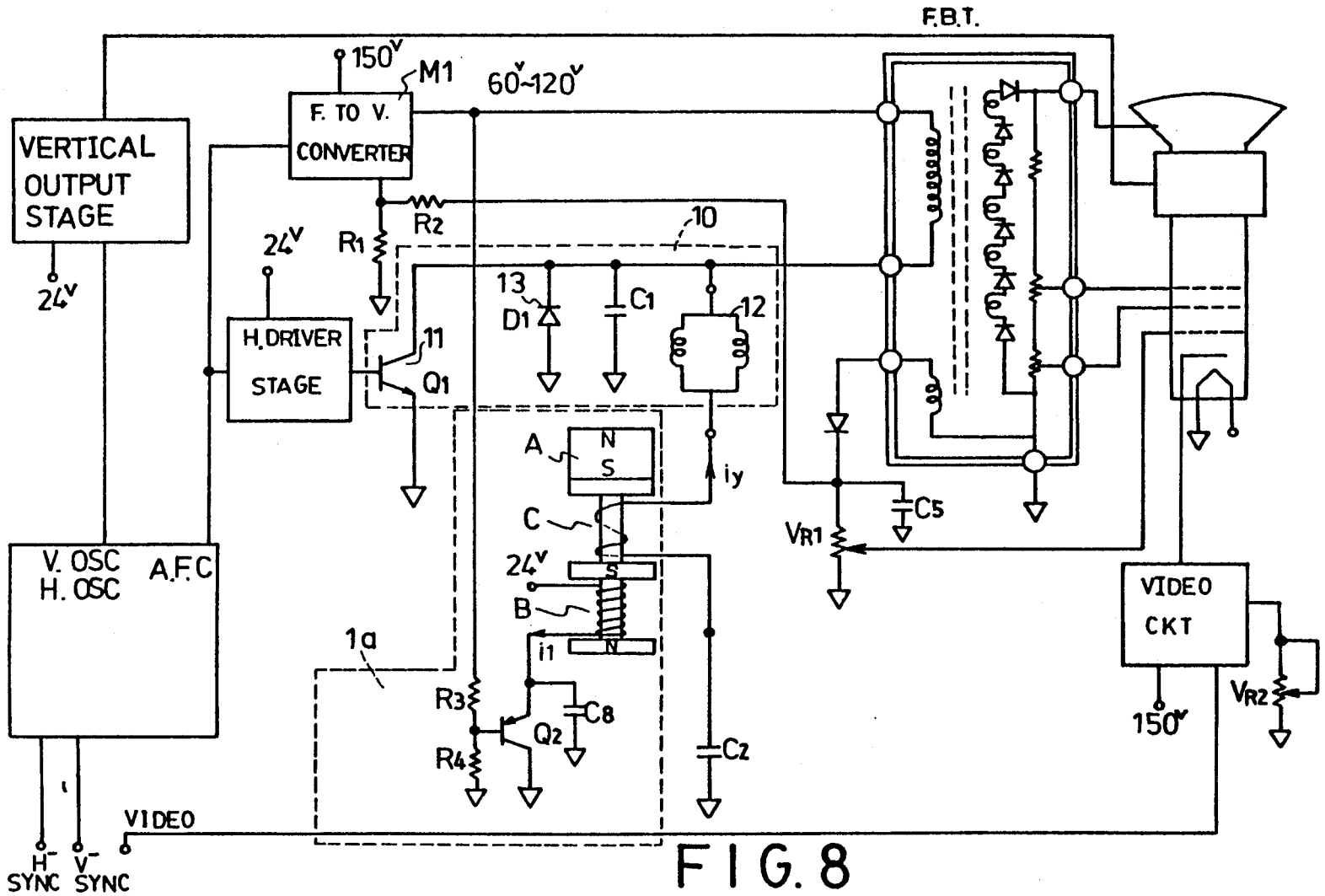
FIG. 8 is a schematic circuit diagram of the first preferred embodiment of a linearity compensation apparatus according to the present invention.

Referring to FIG. 8, the first preferred embodiment of a linearity compensation apparatus (1a) according to the present invention is shown to be installed in a multi-scanning monitor that is operable within the 30 kHz to 60 kHz scanning frequency range. The succeeding paragraphs will illustrate how the first preferred embodiment can provide linearity compensation which varies in accordance with the magnitude of the horizontal scanning frequency.

The current control circuit of the linearity compensation apparatus (1a) is connected to a frequency to voltage converter (M1) of the multi-scanning monitor. The converter (M1) generates a voltage signal to a fly-back transformer (F.B.T.) of the multi-scanning monitor, which voltage signal corresponds to the horizontal scanning frequency from the external display adapter which is in use. This permits the generation of a fixed picture width and stable high voltage. A capacitor (C5) is charged to a stable DC voltage signal which is proportional to the horizontal scan width. The voltage across the capacitor (C5) is fed to the converter (M1) via negative feedback resistors (R1, R2). Every time the horizontal scanning frequency changes, the converter (M1) provides a voltage signal which corresponds to the horizontal scanning frequency so as to maintain a fixed picture width and stable high voltage. (A detailed description of the internal circuitry of the multi-scanning monitor is omitted herein since this is beyond the scope of the present invention).

The current control circuit of the linearity compensation apparatus (1a) includes a pair of resistors (R3, R4) which cooperatively form a voltage divider network that is connected to the converter (Ml). The base terminal of a PNP transistor (Q2) is connected to the junction of the resistor pair (R3, R4). The converter (M1) has a voltage output which ranges from the 60 volts to 120 volts. The resistances of the resistors (R3, R4) are selected so that the voltage at the base terminal of the transistor (Q2) is equal to 60 * [R4/(R3+R4)]=12 volts when the horizontal scanning frequency is at 30 kHz, and is equal to 120 * [R4/(R3+R4)]=24 volts when the horizontal scanning frequency is at 60 kHz.

The line coil of the electromagnet (B) has one terminal end connected to a 24 volt power source and an opposite terminal end connected to the emitter terminal of the transistor (Q2). When the horizontal scanning frequency is at 60 kHz, the transistor (Q2) is in a cut-off condition, and no current flows through the line coil of the electromagnet (B). At lower values of the horizontal scanning frequency, the current flowing through the electromagnet (B) gradually increases and is at a maximum value when the scanning frequency is equal to 30 kHz. At this stage, the magnetic field generated by the electromagnet (B) opposes that which is produced by the permanent magnet (A).

Since the voltage output of the converter (M1) is at a maximum (120 volts) when the horizontal scanning frequency is at 60 kHz, the effect of the internal resistance of the horizontal deflection system (10) on the linearity of the monitor is less severe, and only a small amount of inductance change is required for linearity compensation, thus obviating the need for operating the electromagnet (B). When the horizontal scanning frequency is at 30 kHz, the voltage output of the converter (M1) is at a minimum (60 volts), and the effect of the internal resistance on the linearity of the monitor is more severe. The electromagnet (B) generates a magnetic flux which is opposite to that which is generated by the permanent magnet (A). A current ($i_y$) vs. inductance (L) curve with a relatively large negative slope is thus produced to negate the severe effects of internal resistance on the linearity of the CRT.

Figure 9:
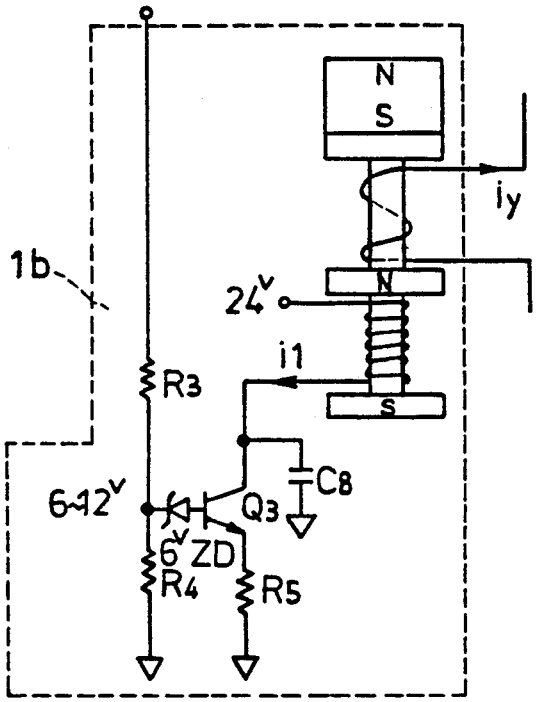
FIG. 9 is a schematic circuit diagram of the second preferred embodiment of a linearity compensation apparatus according to the present invention.

Referring to FIG. 9, the current control circuit of the second preferred embodiment of a linearity compensation apparatus (1b) according to the present invention is shown to include a 6-volt zener diode (ZD) connecting the junction of the resistor pair (R3, R4) to the base terminal of an NPN transistor (Q3). The resistance values of the resistor pair (R3, R4) are selected so that the base terminal of the transistor (Q3) receives a 6 to 12 volt signal, depending upon the magnitude of the horizontal scanning frequency. When the voltage across the resistor (R4) is at 6 volts (that is, the scanning frequency is at 30 kHz), the current flowing through the line coil of the electromagnet (B) is equal to zero. At scanning frequencies which are higher than 30 kHz, the current flowing through the line coil of the electromagnet (B) increases and reaches a maximum value of approximately (6 volts−0.6 volt)/R5 when the scanning frequency is equal to 60 kHz. The magnetic flux generated by the electromagnet (B) is in the same direction as that which is generated by the permanent magnet (A). The resulting current ($i_y$) vs. inductance (L) curve is equivalent to the lowermost curve shown in FIG. 7(B).

Figure 10:
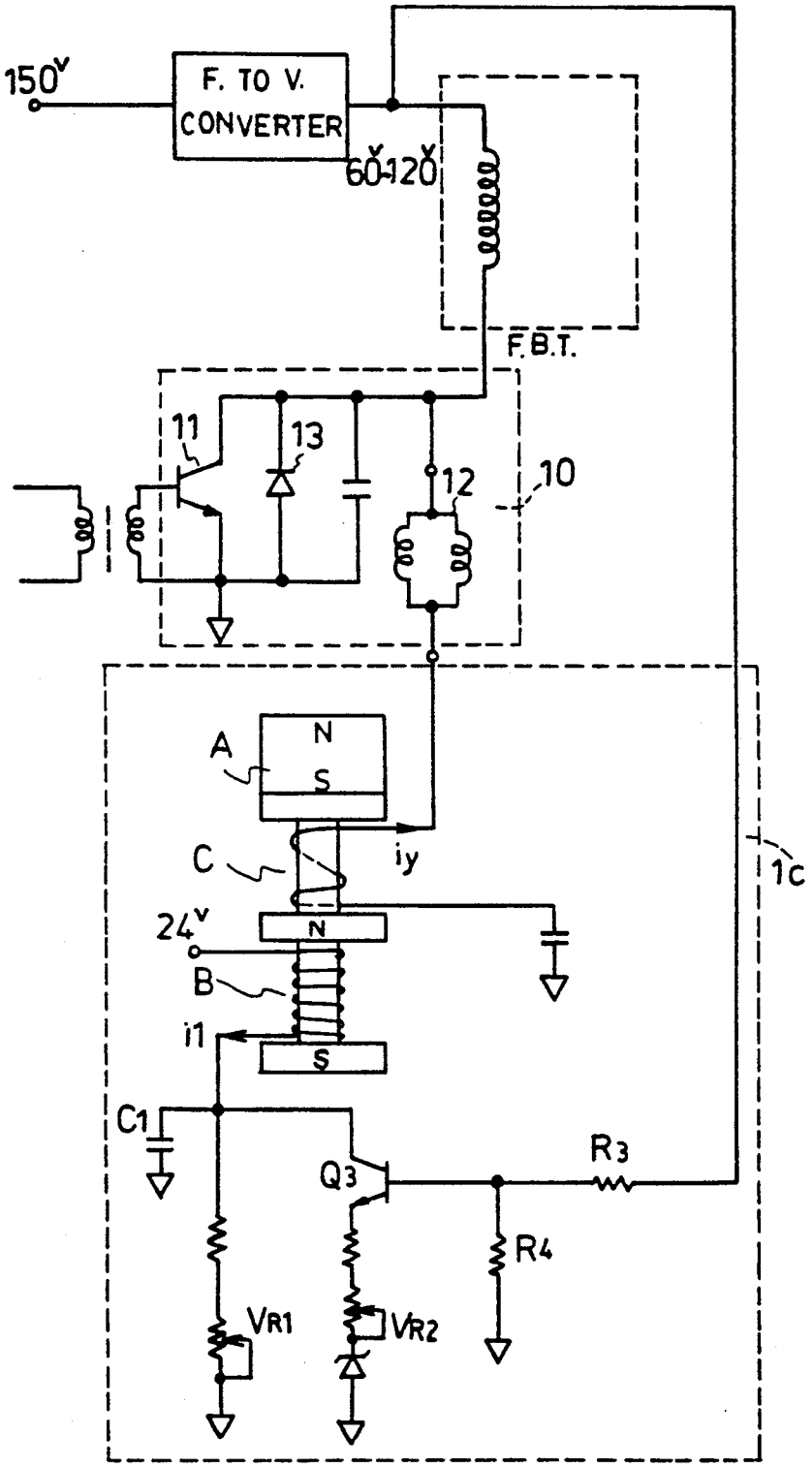
FIG. 10 is a schematic circuit diagram of the third preferred embodiment of a linearity compensation apparatus according to the present invention.

The third preferred embodiment of a linearity compensation apparatus (1c) according to the present invention is shown in FIG. 10. The line coil of the electromagnet (B) is in series with a potentiometer (VR1) and with the collector terminal of the NPN transistor (Q3). The values of a resistor pair (R3, R4) and the zener diode in series with a potentiometer (VR2) are selected so that when the third preferred embodiment is operating in the lower scanning frequency range (30 kHz to 45 kHz), the bias voltage at the base terminal of the transistor (Q3) is insufficient to trigger the transistor (Q3) into a conducting state. The potentiometer (VR1) is adjusted so as to permit initial tuning of the current flowing through the line coil of the electromagnet (B). When the third preferred embodiment is operating in the higher scanning frequency range (45 kHz to 60 kHz). the voltage at the base terminal of a transistor (Q3) is higher than that at the emitter terminal of the same, thus placing the transistor (Q3) in the conducting state. The potentiometer (VR2) can be adjusted so as to permit further tuning of the current flowing through the line coil of the electromagnet (B).

Figure 11:
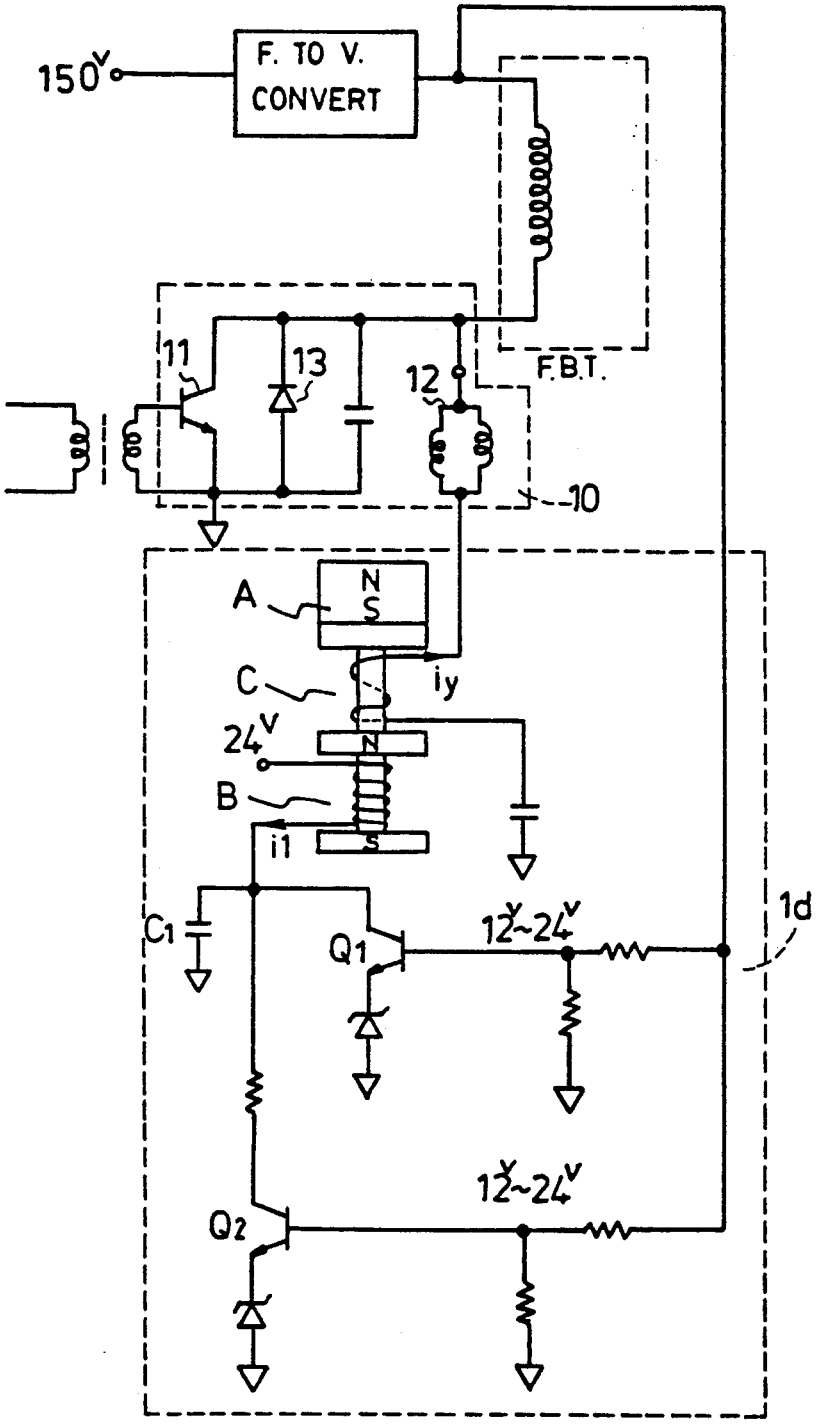
FIG. 11 is a schematic circuit diagram of the fourth preferred embodiment of a linearity compensation apparatus according to the present invention.
Figure 12:
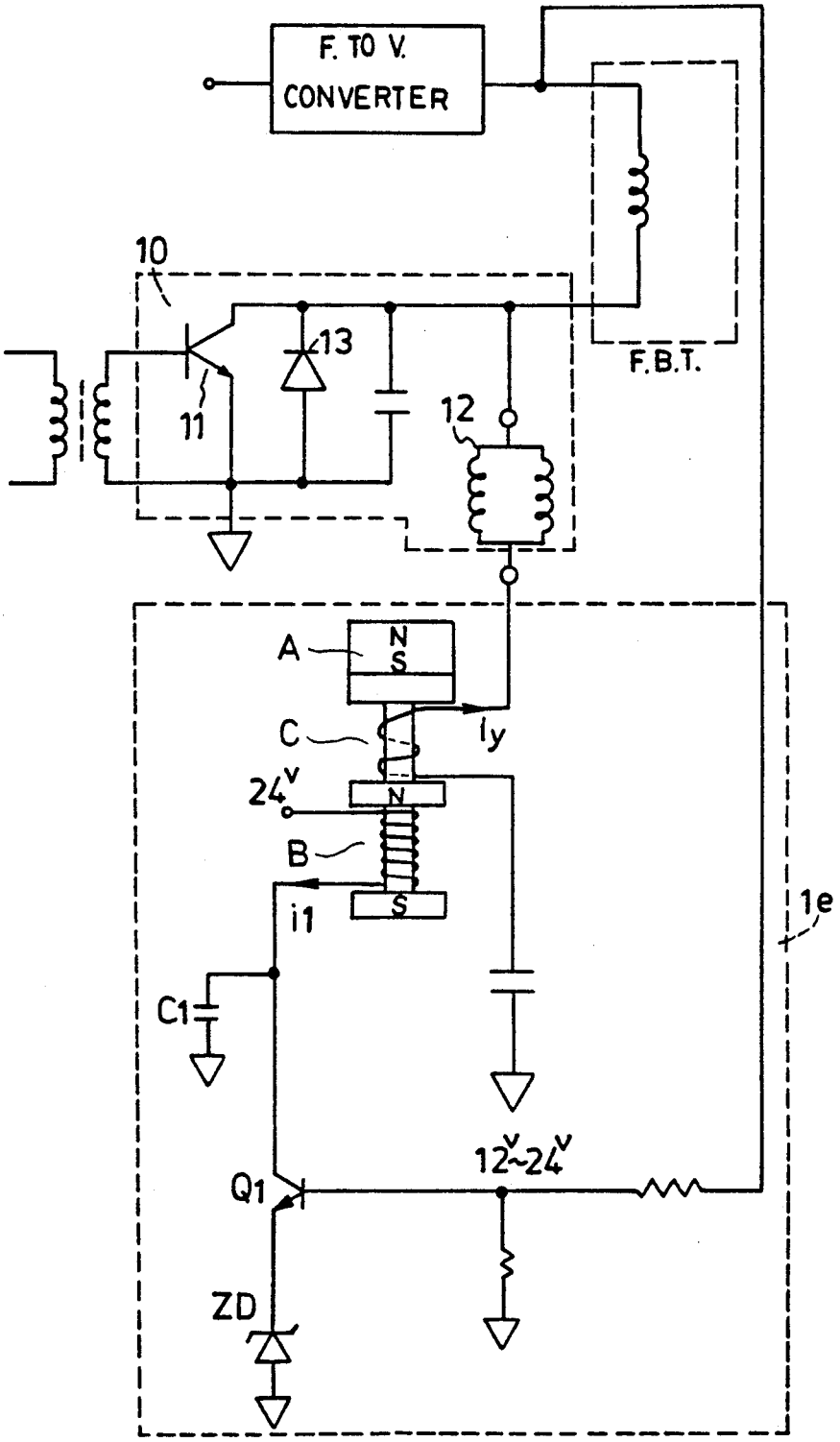
FIG. 12 is a schematic circuit diagram of the fifth preferred embodiment of a linearity compensation apparatus according to the present invention.

The fourth and fifth preferred embodiments of a linearity compensation apparatus (1d, 1e) of the present invention are shown in FIGS. 11 and 12, respectively. The main difference between the fourth and fifth embodiments and the preceding embodiments resides in the configuration of the current control circuit.

It has thus been shown that a wide variety of current control circuits can be employed so as to attain the objectives of the present invention.

Note that the core of the electromagnet can be fabricated in different shapes and sizes. By varying the current through the electromagnet (B, B') so as to correspond with the horizontal scanning frequency, the magnetic field strength and the polarity of the electromagnet (B, B') can be adjusted so as to obtain a linearity compensation apparatus which provides better compensation effect for a wide range of scanning frequencies.

It should be noted that the linearity compensation apparatus of the present invention does not require the use of relays and therefore has a smaller size, a lower manufacturing cost, and a simple and less complicated construction.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A linearity compensation apparatus for a multi-scanning monitor having a magnetic deflection-type cathode ray tube, a voltage signal that corresponds to a horizontal scanning frequency from an external display adapter, and a horizontal deflection system with a deflection coil, said linearity compensation apparatus comprising:

a linearity coil including a coil device which has an I-shaped ferrate core and a coil member wound on said ferrate core and to be connected in series with said deflection coil, and a permanent magnet mounted on one end of said ferrate core of said coil device;

an electromagnet having an I-shaped core with one end mounted on the other end of said ferrate core of said coil device and a line coil wound on said core; and a current control circuit means receiving said voltage signal from said multi-scanning monitor, said current control circuit means controlling the amount of current flowing through said line coil of said electromagnet so as to correspond with said voltage signal from said multi-scanning monitor, thereby varying the magnetic field strength of said electromagnet in order to vary automatically the relationship between the inductance and the current flowing through said linearity coil in accordance with the magnitude of the horizontal scanning frequency from the external display adapter.

2. A linearity compensation apparats for a multi-scanning monitor having a magnetic deflection-type cathode ray tube, a voltage signal that corresponds to a horizontal scanning frequency from an external display adapter, and a horizontal deflection system with a deflection coil, said linearity compensation apparatus comprising:

a linearity coil including a coil device which has an I-shaped ferrate core and a coil member wound on said ferrate core and to be connected in series with said deflection coil, and a permanent magnet rotatably mounted on said coil device adjacent to said ferrate core and being disposed between two ends of said ferrate core;

an electromagnet having a U-shaped core with two ends mounted respectively on said two ends of said ferrate core of said coil device and a line coil wound on said core; and a current control circuit means receiving said voltage signal from said multi-scanning monitor, said current control circuit means controlling the amount of current flowing through said line coil of said electromagnet so as to correspond with said voltage signal from said multi-scanning monitor, thereby varying the magnetic field strength of said electromagnet in order to vary automatically the relationship between the inductance and the current flowing through said linearity coil in accordance with the magnitude of the horizontal scanning frequency from the external display adapter.

* * * * *